US005129610A

United States Patent [19]

Campbell

[11] Patent Number: 5,129,610

[45] Date of Patent: Jul. 14, 1992

[54] GIMBALLED ADJUSTABLE HOLDER FOR NURSING BOTTLE

[76] Inventor: Gregory A. Campbell, 14037 Rabbit Rd., Sylmar, Calif. 91342

[21] Appl. No.: 725,002

[22] Filed: Jul. 2, 1991

[51] Int. Cl.[5] ..... A47D 15/00

[52] U.S. Cl. ..... 248/106; 248/311.2

[58] Field of Search ..... 248/105, 106, 107, 130, 248/311.2, 237, 148, 710, 137

[56] References Cited

U.S. PATENT DOCUMENTS

| | | | |
|---|---|---|---|
| 2,638,296 | 5/1953 | Battle | 248/105 |
| 2,639,111 | 5/1953 | Wells | 248/105 |
| 2,648,513 | 8/1953 | Groff | 248/107 |
| 2,681,782 | 6/1954 | Morishita | 248/106 |
| 2,828,097 | 3/1958 | Faunce | 248/106 |
| 2,909,345 | 10/1959 | Matsuoka | 248/106 |
| 2,935,282 | 5/1960 | Lykes | 248/106 |
| 2,989,278 | 6/1961 | Hyman | 248/106 |
| 3,028,133 | 4/1962 | Craig | 248/106 |
| 3,222,020 | 12/1965 | Rea | 248/106 |
| 3,999,731 | 12/1976 | Filip | 248/106 |
| 4,315,654 | 2/1982 | Crook | 297/188 |
| 4,627,588 | 12/1986 | Block | 248/105 X |
| 4,702,719 | 10/1987 | Lapid | 248/107 |
| 4,733,836 | 3/1988 | Barnes | 248/106 |
| 4,733,837 | 3/1988 | Aguirre | 248/106 |
| 4,735,388 | 4/1988 | Marks | 248/103 |

FOREIGN PATENT DOCUMENTS 1444873 8/1976 United Kingdom .

*Primary Examiner*—David L. Talbott

[57] ABSTRACT

A gimballed adjustable holder for a nursing bottle comprised of a base assembly (10), a gimbal support (16) which is vertically adjustable with respect to the base assembly and rotatable about the base and gimbal support pivot (34) for use in various positions and locations, an inner gimbal (24) and outer gimbal (20) which permits pivotal movement of the nursing bottle in order to compensate for movements of an infant during feeding. The bottle is held in place within the inner gimbal in a bottle support (26) and secured via a bottle retention strap (28).

7 Claims, 5 Drawing Sheets

GIMBALLED ADJUSTABLE HOLDER FOR NURSING BOTTLE

BACKGROUND

1. Field of Invention

This invention relates to a device for holding a nursing bottle for an infant. Specifically, this invention is a portable gimballed device for the support and angular adjustment, by the infant, of a nursing bottle.

2. Discussion of Prior Art

The nursing of an infant can be very time consuming. Also, it can be very physically taxing on the person tasked with this effort. Couple with this the fact that an infant's desire to be fed is independent of the activities taking place around him. This usually requires the parent to leave what they are doing to feed the infant. This is because bottle-fed infants require that their bottles be held by someone else. Typically, infants are not capable of supporting or controlling a bottle during the first 9–12 months. And also important is the fact that manual feeding aids in the parent-child bonding process early in the infant's development. But, in todays fast-past society, typically, both parents are required to take on a large amounts of responsibility in maintaining a household.

Infant care outside of the household, in hospitals and day-care centers, have been faced with increasing staffing shortages. These shortages have led to increased stress and frustration on both the part of these staffs and the infants in their care.

This device will assist in the above mentioned areas of infant care. This will be achieved by minimizing the manual involvement of parents and other infant attendants during feeding. The attendant will only be required to visually observe the baby during feeding.

Heretofore, a number of inventors have attempted to develop adequate holders for nursing baby bottles. But all have fallen short, in one way or another, of addressing a majority of the related problems. And almost always overlooked are the problems faced by the purchaser of such a device, the parent or institution. This is one major reason there has been no widespread acceptance of any of the prior art. The present invention has been designed to improve upon the prior art from a number of different aspects. Primarily, it seeks to adequately serve the needs of both infant and parent or infant care worker.

In reviewing the prior art, we find a number of problems that prevented them from completely serving the needs of the users. One major problems with most of the prior art is that they can only be used in one nursing venue. Devices like that shown in U.S. Pat. No. 4,735,388 to Marks, Apr. 5, 1988 requires clamping to a rigid member of a crib. Or U.S. Pat. No. 4,315,654 to Crook, Feb. 16, 1982 is only useable when secured to an infant seat. These devices add additional constraints to the infant feeding operation. A nursing bottle holder should not impose severe limits on the number of places the infant can be fed. It should easily adapt to the location of the baby or a place selected by the parent or attendant.

In addition to being venue limited, other devices provide either too much or too little support for the bottle. U.S. Pat. No. 4,733,837 to Aguirre, Mar. 29, 1988 holds the nursing bottle rigidly preventing a baby from moving his head. This prevents the infant from observing things going on around him, which leads to a feeling of isolation for the child. Also, when the liquid in the bottle reaches a certain level, the infant begins ingesting air. This can lead to Colic. In U.S. Pat. No. 4,733,836 to Barnes, Mar. 29, 1988 the bottle is fixed and the infant is placed at an angle. This confines the baby to a single awkward resting position. The high side wall prevents the baby from looking around during feeding. And the holding device makes ejection of the bottle, by the infant, almost impossible.

On the other extreme, U.S. Pat. No. 2,828,097 to Faunce, Mar. 25, 1958 is but one example of a number of inventions that used the free swinging bottle technique. This type of device suspends the bottle from one or more chains, ropes, or elastic straps. This system allows for a wide range of motion. This allows movement by the baby, but does not adequately control this movement for the baby. In addition, if the baby releases the bottle momentarily, it is unlikely the baby could recover the bottle without assistance. Also, due to the inherent instability of this type of design, an active baby could cause the bottle to swing or bounce about violently. This event could possibly injure or scare the infant.

In an effort to address the bottle stability problem, some prior art inventions attempt to allow for movement of the baby during nursing. This is important from a number of standpoints, for example it allows the baby to adjust himself to reduce fatigue. And also, the infant is free to observe things around it. But these designs fall short in aiding in the development of the infant's head-eye and hand-eye coordination. This should be achieved by the infant observing the motion of the bottle relative to his or her own movements. This is a first step towards the baby being able to control the bottle and nurse independently. Nor do these designs attempt to allow the moveable bottle to be released and recovered by the infant. The invention detailed in U.S. Pat. No. 3,999,731 to Filip, Dec. 28, 1976 attempts to allow movement of the nursing bottle, but suffers from some of the drawbacks associated with the hanging bottle holders mentioned in the previous paragraph. In most positions, release of the bottle by the infant can result in the bottle swinging about and possibly harming the child. And, while nursing, the infant must support the weight of the bottle (and its contents) and the bottle gripping device with his lips and gums. In addition, although it is claimed that the bottle can move in three mutually perpendicular directions, this motion is complex and unnatural. Each of the degrees of freedom are coupled and interrelated. In other words, in order to move the bottle vertically, the infant must also move an equal amount horizontally. This is confusing for the developing infant and does not properly aid in the accurate development of the infant's coordination or motor skills. Even though this particular design is a stand-alone unit, it has several other drawbacks. Most significant amongst them is the fact that due to its considerable structure, access to the baby during feeding for things such as changing a diaper is not possible. Also, the inventor claims that this design is portable. But this requires a parent to carry around at least two large and awkward U-shaped metal supports, which could be easily damaged in the process. In U.S. Pat. No. 3,028,133 to Craig, Apr. 3, 1962 the bottle position can be adjusted in height above the infant, but no provision is made for movement by the baby during nursing. In addition, this rather large and relatively heavy device requires that the baby exert continuous effort in order to keep the bottle in his mouth. If the baby releases pressure on the bottle nipple momentarily, the bottle is immediately snapped away and is not recoverable by the infant. This can be a cause of much frustration on the part of both the infant and the parents.

It is also important to note that with almost all of the prior art designs, no effort has been put into providing for use of the device in the event it is required to be installed, after nursing by hand has begun, without interrupting feeding. Once feeding is interrupted considerable effort is often required to get the infant to resume feeding. This is important in the event that a situation arises, during parent-assisted feeding, that requires the immediate attention of the parent. This interruption should not cause the infant's feeding to be suspended.

OBJECTS AND ADVANTAGE

Accordingly, several objects and advantages of my invention are:

(a) to provide a holder apparatus for a nursing bottle that allows the infant to move his head up and down and side-to-side without interrupting the feeding process. Also, this device, unlike the prior art chains elastic bands, etc., will provide freedom for the nursing infant, but prevent possible injury by sufficiently controlling movement to allow successful manipulation of the bottle by the baby.

(b) to provide a holder apparatus for a nursing bottle that is safe, compact, stable, and can be used with, but does not require additional infant furniture or devices.

(c) to provide a holder apparatus for a nursing bottle that allows an infant to be nursed in a number of locations and feeding positions. The baby can be nursed in a car seat, baby chair, crib, laying flat or inclined on almost any surface.

(d) to provide a holder apparatus for a nursing bottle to allow easy access to the infant, during use, for changing of clothing or diapers.

(e) to provide a holder apparatus for a nursing bottle which is foldable for ease of transport and storage.

(f) to provide a holder apparatus for a nursing bottle which allows movement of the bottle that will be consistent with the baby's expectations and accurately assist in the baby's motor skill development.

Further objects and advantages are to provide a holder apparatus for a nursing bottle which allows installation of the device during manual nursing, without interrupting the feeding process, a holder apparatus which is lightweight, and which prevents the infant from ingesting air while there is still liquid in the nursing bottle. Still further objects and advantages will become apparent from a consideration of the ensuing descriptions and drawings.

DESCRIPTION OF DRAWINGS

In the drawings, closely related figures have the same number but different alphabetic suffixes.

LIST OF REFERENCE NUMERALS

| | |
|---|---|
| 10 base assembly | 12 lower leg section |
| 14 upper leg section | 16 gimbal support |
| 18 outer gimbal pivot | 20 outer gimbal |
| 22 inner gimbal pivot | 24 inner gimbal |
| 26 bottle support | 28 bottle retention strap |
| 30 outer gimbal stop | 32 inner gimbal stop |
| 34 base and gimbal support pivot | 36 leg height adjustment collar |
| 38 gimbal support thumb screw | 40 leg angle adjustment screw |

DESCRIPTION OF INVENTION—FIGS. 2, 3, 4, 7

Figure 2:
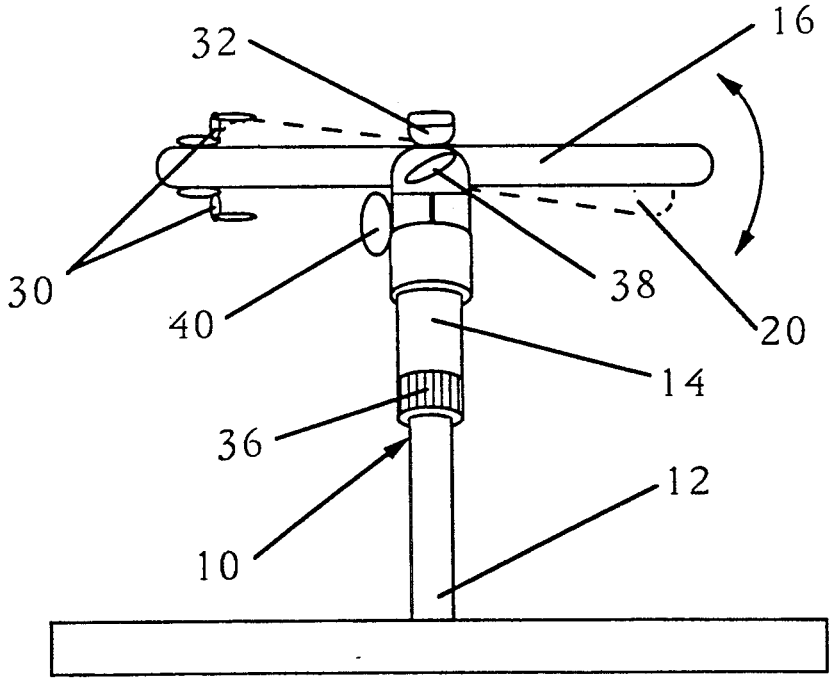
FIG. 2 is a side elevation view of the holder apparatus of FIG. 1
Figure 3:
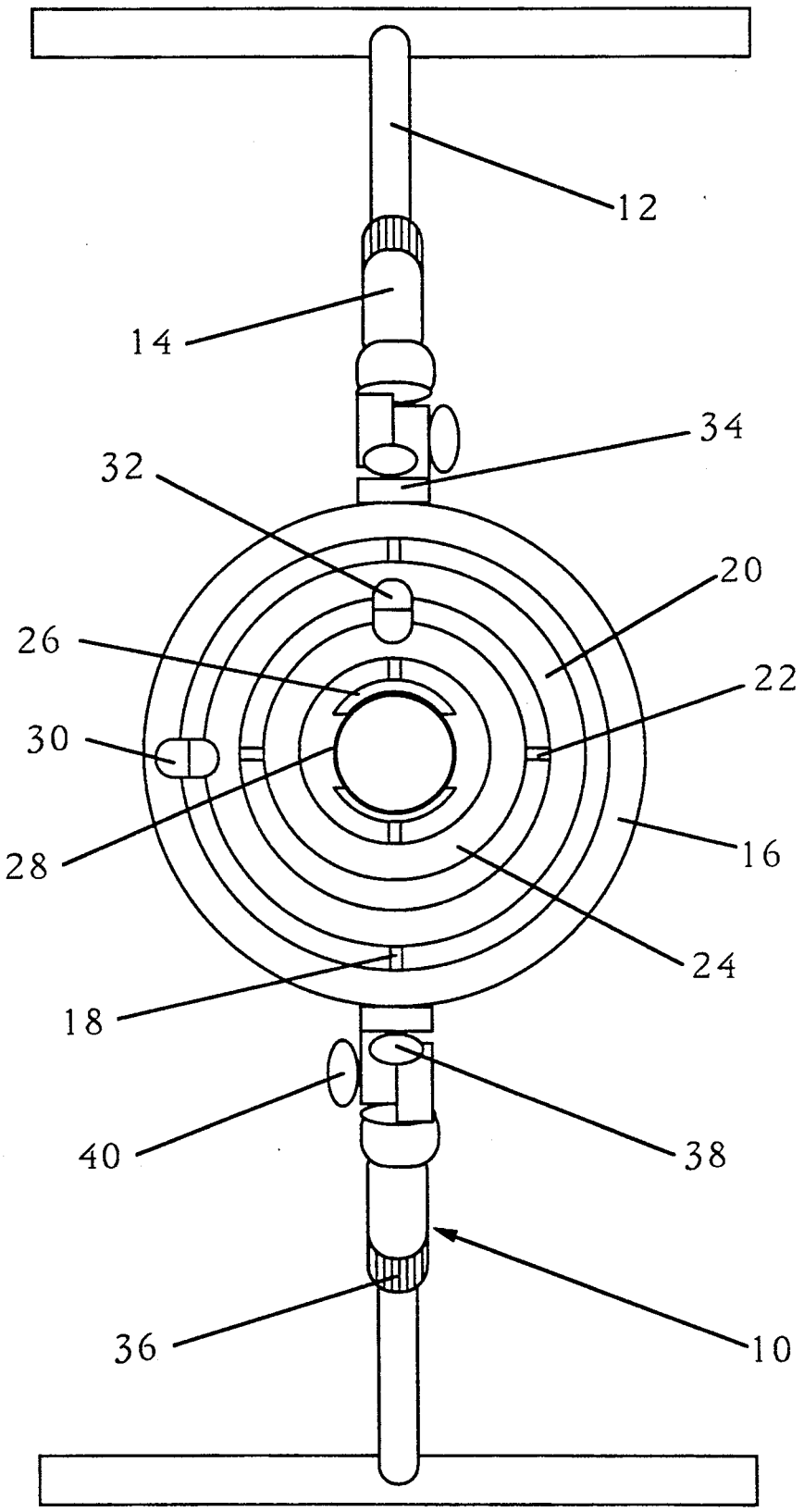
FIG. 3 is a top view of the holder apparatus of FIGS. 1 and 2.
Figure 4:
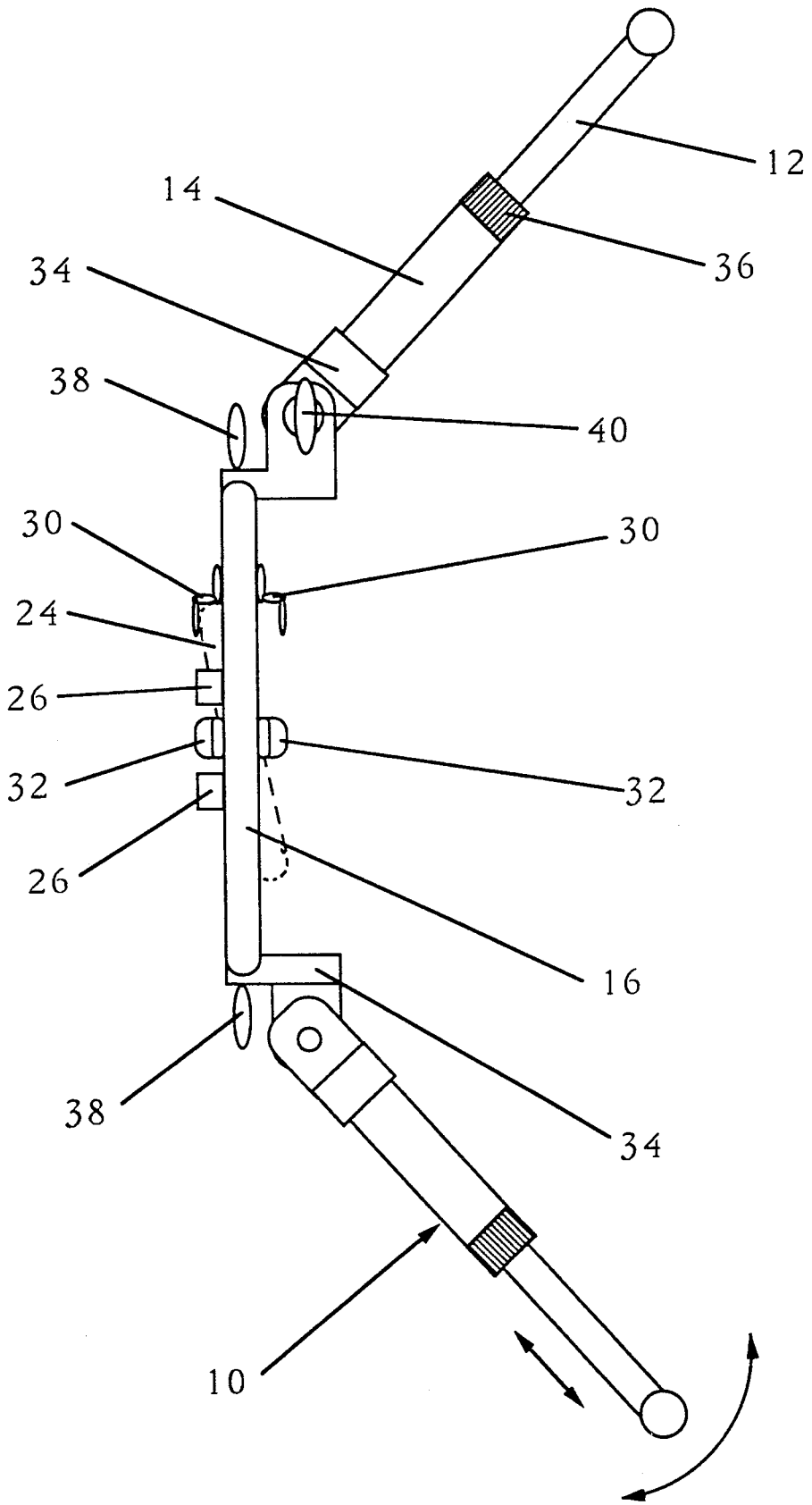
FIG. 4 is a front view of the holder apparatus of FIGS. 1, 2, and 3

A typical embodiment of the holder apparatus of the present invention is illustrated in FIGS. 2 (side view), 3 (top view) and 4 (front view). The holder apparatus has a base assembly 10 consisting of two T-shaped legs. These legs are made up of one straight upper leg section 14 and one short T-shaped lower leg section 12 which is disposed and slidable mounted in a bore in the upper leg section 14. The base assembly is joined to the gimbal support 16 via the base and gimbal support pivot 34. The base and gimbal support pivot 34 utilizes four (two per side) threaded thumb screws, the gimbal support thumbs screw 38 and the leg angle adjustment screw 40, to join the base assembly 10 and gimbal support 16. The base and gimbal support pivots 34 allow the gimbal support to be adjusted to match the infant's upper torso incline angle. The base and gimbal support pivots 34 also allow the angle of the base assembly 10 to be adjusted to adapt the holder apparatus height and base width. The structure formed by the base assembly and gimbal support provides considerable stability. This is due to its trapezium-shaped profile. In use, the height of the resultant trapezoid is less than the width of the base assembly. And this height is not substantially greater than the length of the lower leg sections 12 that are in contact with the surface the unit is resting on. This stability helps the holder apparatus resist being knocked over. Also, the materials used will be selected to add to the overall rigidity of the system. In the preferred embodiment the base assembly 10, the base and gimbal support pivot 34, and the gimbal support 16 are made out of a high impact ABS plastic.

Preferably made out of a less rigid plastic, such as Polyethylene, are the outer gimbal 20 and the inner gimbal 24. The outer gimbal 20 is mounted within the inner diameter of the gimbal support 16. The outer gimbal 20 is joined to the gimbal support 16 via two outer gimbal pivots 18. The inner gimbal 24 is located within the inner gimbal of the outer gimbal 20 and is joined to the outer gimbal 20 via two inner gimbal pivots 22. These pivots allow only rotation of the gimbals about the pivot centerlines. The pivots are made out of a firm plastic, such as a high impact ABS plastic.

A firm plastic may again used for the bottle support 26, which is rigidly mounted within the inner diameter of the inner gimbal 24. The two sides of the bottle support 26 can be made to be radially adjustable and securable in order to accommodate various bottle sizes. Attached to the bottle support 26 is the bottle retention strap 28. The bottle retention strap 28 is attached to one side of the bottle support 26 and is long enough to wrap around a nursing bottle and the other side of the bottle support 26 be secured via a temporary adhesive material, such as Velcro.

The limits of bottle travel are defined by the inner gimbal stop 32 and the outer gimbal stop 30, which limit the angular travel of the bottle. These stops allow adequate travel to allow the infant to move his head from side-to-side and up and down without a loss of comfortable contact with the bottle. By limiting the travel of the bottle, the bottle remains in relatively close proximity for retrieval of the bottle by the infant. Also, the maximum velocity of the bottle is kept low due to this limited angular travel. This prevents injury to the infant in the event an active infant loses control of the nursing bottle.

Figure 7:
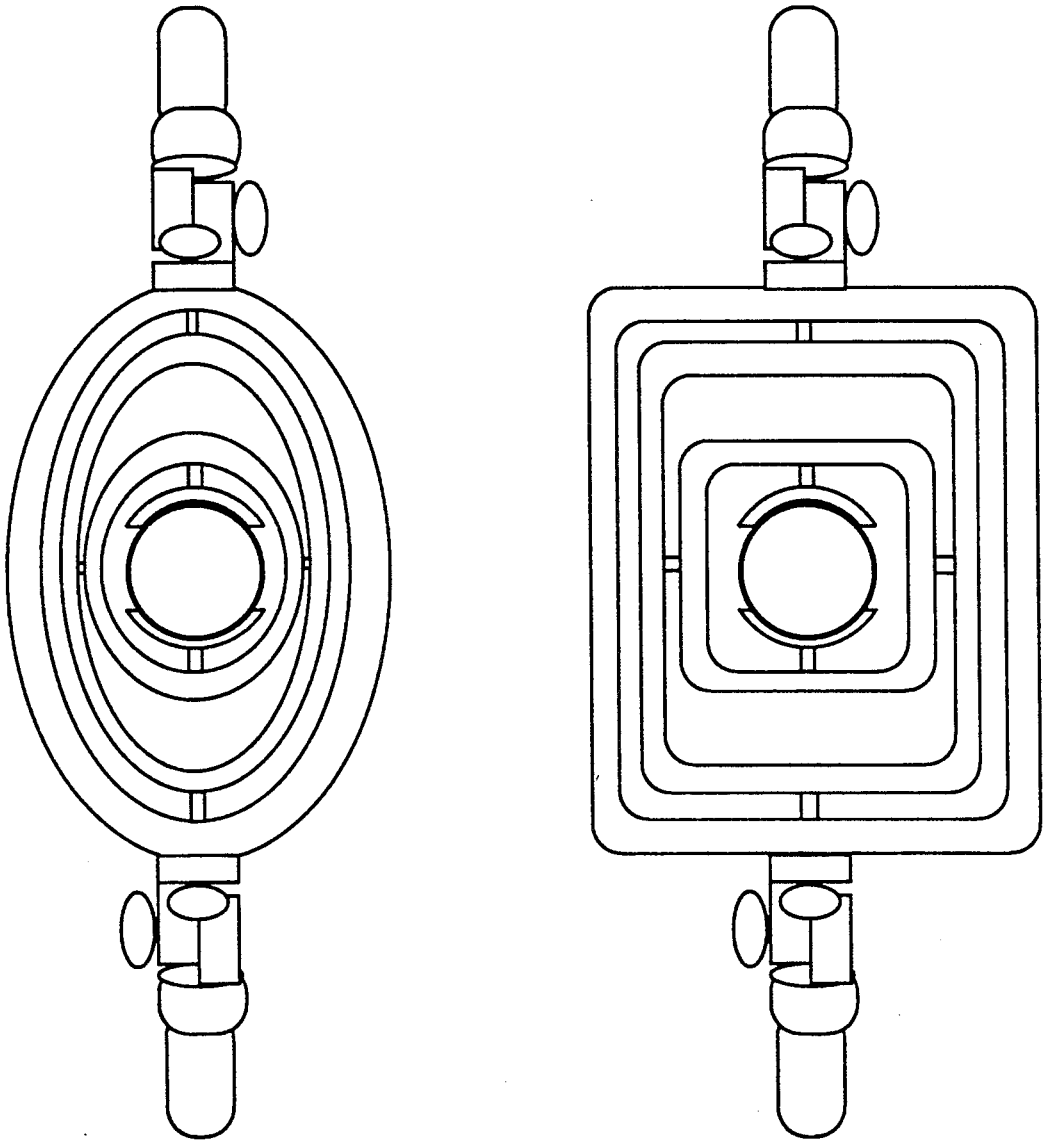
FIG. 7 shows plan views of holder apparatus gimbal supports and gimbals with various modifications to the gimbal shapes.

There are various possibilities with regards to the relative disposition of shapes of the gimbals and gimbal support. FIG. 7 shows several such possibility in which the gimbal shapes are other than round.

From the description above, a number of advantages of this invention become evident:

(a) A number of simple-to-use adjustments are available to allow use of the device in a number of feeding venues.

(b) The weight of the bottle and its contents are supported by the structure and not by the infant.

(c) The bottle support and bottle retention strap allow the unit to be lowered over a baby being manually feed and secured to the bottle.

(d) The articulated joints which connect the base assembly to the support structure make transport and storage of the device easy.

(e) With this invention in use, the lower portion of the infant is accessible to allow changing of the infants clothing or diapers.

(f) The limits on gimbal movement allow the infant to recover the bottle in the event the infants removes the bottle from its mouth.

(g) The colors of the gimbals and the support structure can be varied to be appealing to the infant.

OPERATION OF INVENTION—FIGS. 1 TO 6

The manner of using the holding apparatus to nurse an infant is to place the infant on a flat surface (with the infant's back inclined or flat) or in an infant seat. Prior to placing the unit over the infant, the gimbal support 16 must be adjusted to match the angle between the infant's back and the resting surface. It is releasably locked in place by friction forces applied by means of the gimbal support thumb screws 38. Once the gimbal support thumb screws 38 are loosened, the gimbal support 16 can be rotated about the axis formed by the centerlines of the gimbal support thumb screws 38 to match the infant's incline angle.

Next, the height of the gimbal support 16 must be adjusted. This is accomplished by loosening the releasably locked leg height adjustment collars 32. Once the desire height for the unit is achieved, the let height adjustment collars 32 is resecured. Alternately or in conjunction, height adjustments can also be achieved by loosening the leg angle adjustment screws 40 and adjusting the leg angle until the desired height is achieved. This redundant height adjustment system allows greater flexibility in the locations this device can be employed.

Figure 1:
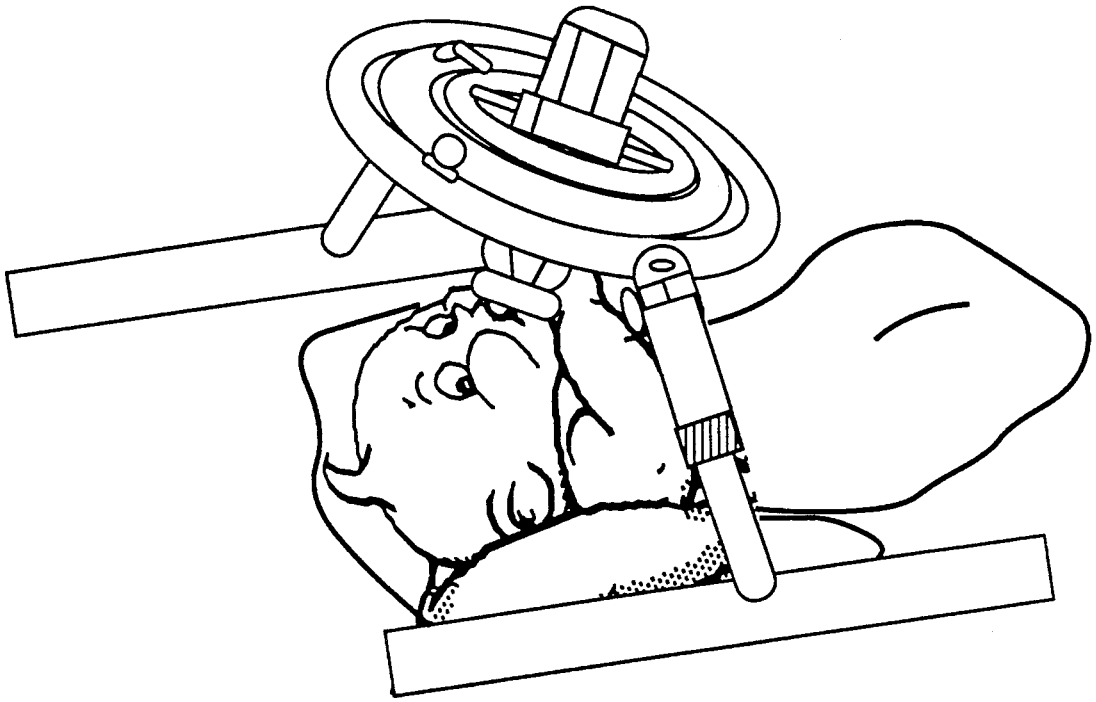
FIG. 1 is a perspective view of a preferred embodiment of the invention in use in nursing an infant.

Once all adjustments have been completed, the unit can be lowered over the infant. The unit is positioned with the center of the gimbal diameters directly in line with the mouth of the infant and the lower leg sections 12 in contact with the surface running parallel to the infant's body as shown in FIG. 1. The nursing bottle is then inserted through the bottle support 26 into the infant's mouth. Once in the mouth of the infant, the bottle is secured using the bottle retention strap 28.

If the infant is nursing, the unit is lowered over the infant in the same manner as above. But, the nursing bottle is inserted in the opening of the bottle support 26 as the unit is lowered over the infant. Once in place, the bottle is secured using the bottle retention strap 28.

Figure 5:
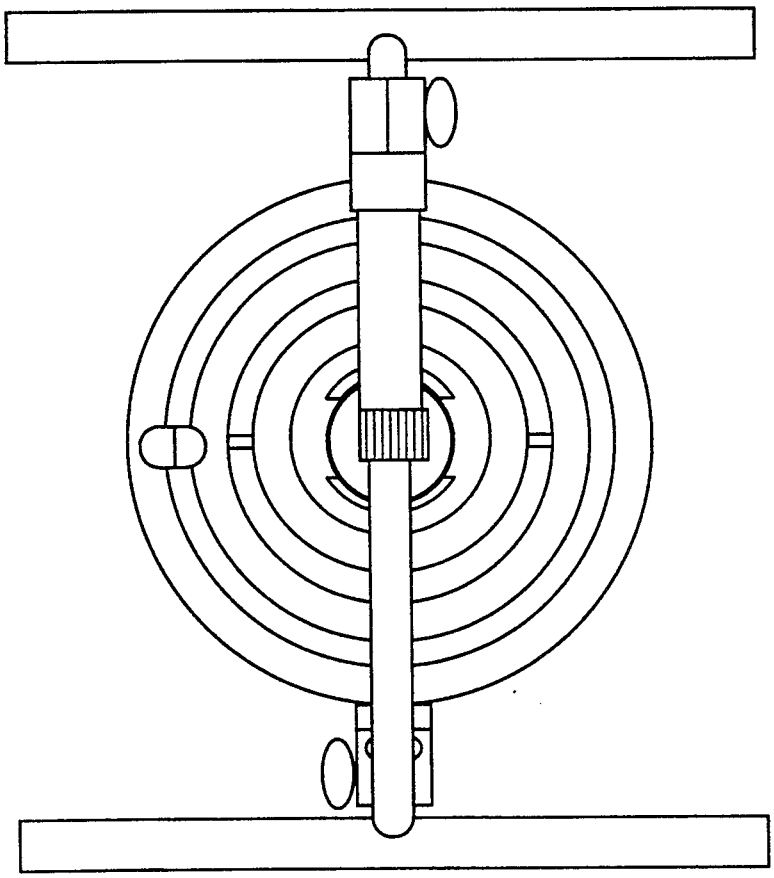
FIG. 5 is a top view of the holder apparatus of FIGS. 1, 2, 3 and 4 in the transportable or storage configuration.
Figure 6:
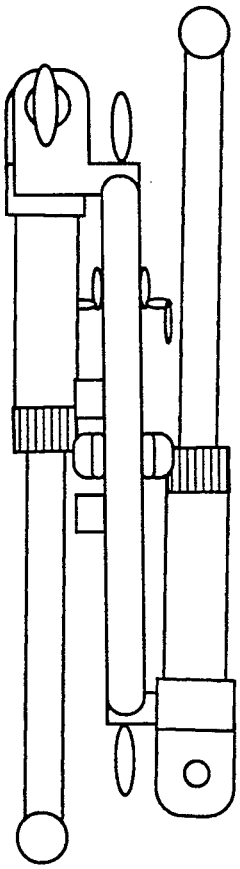
FIG. 6 is a side view of the holder apparatus of FIGS. 1, 2, 3, 4, and 5 in the transportable or storage configuration.

To secure the holder apparatus for storage or transport, the gimbal support 16 must be moved to a position in which its plane is parallel to the lower leg sections 12 in contact with the ground or other flat surface. This is accomplished using the gimbal support thumb screws 38. Unlock leg height adjustment collar 36 and adjust the legs to a desired length. Tighten leg height adjustment collar 36. Next, one leg is rotated 180 degrees about the gimbal support thumb screw 38. At this point, both gimbal support thumb screws 38 can be tightened. Loosening both leg angle adjustment screws 40 and fold both leg toward the center of the unit. Secure both angle adjustments screws 40. Either of the lower leg sections 12 serve as a handle in this transport position. The resulting configuration is shown in FIGS. 5 and 6.

SUMMARY, RAMIFICATIONS AND SCOPE

It will be appreciated that when the infant is nursing, the units design allows it to be put into use with one hand while guiding the bottle into the bottle support 26 with the other. In addition, when the unit is in place and being used by an infant, the infant's lower body is free of the unit. This prevents the infant from kicking the unit over. Also, this allows the parent to have easy access to infant's lower body for dressing or diaper changing purposes. Furthermore, this invention has the additional advantages in that

- it is easily folded to a size suitable for transportation or storage;
- it is readily adjustable for use in a number of nursing venues which may be encountered;
- it supports the bottle in a manner that minimizes the pressure on the infant's lips and gums;
- it allows bottle movements which are simple and consistent with the motor skill development of the infant;
- it allows the bottle to be recovered, by the infant, in the event the infant desires to take a rest from feeding.

Although the description above contains many specificities, these should not be construed as limiting the scope of the invention, but as merely providing illustrations of some of the presently preferred embodiments of this invention. For example, the gimbals can have other shapes, such as oval, trapezoidal, square, etc.; four legs can be use instead of two; toys or animals can be attached to or suspended from the structure, etc.

Thus the scope of the invention should be determined by the appended claims and their legal equivalents, rather than by the examples given.

I claim:

1. A holding apparatus for a nursing bottle comprising:

a base assembly which is independently adjustable in vertically height and in horizontal span, whereby said apparatus can be used with or without infant seats or on various width feeding surfaces;

a gimbal support structure mounted to said base assembly which is rotatably adjustable with respect to said base assembly, whereby said support structure and any apparatus mounted therein can be tilted to accommodate an infant nursing while laying flat or seated in a full upright position or the full range of inclined positions in between;

an outer gimbal means, which is mounted within said gimbal support structure, that is freely rotatable with respect to said gimbal support structure about an axis intersecting or parallel to the rotation axis of said gimbal support structure;

an inner gimbal means, which is mounted within said outer gimbal, that is freely rotatable with respect to said outer gimbal about an axis intersecting the rotation axis of said outer gimbal; and a bottle support means mounted within said inner gimbal, whereby said bottle support can secure a large variety of nursing bottles without adversely affecting the function of either said apparatus or the nursing bottle.

2. Holder apparatus as recited in claim 1 wherein mechanical stops are employed to limit the angular travel of both said inner and said outer gimbals, whereby freedom of movement is allowed, without restraint, within an optimum operating area of motion of said apparatus and bottle nipple proximity is maintained within infant's reach.

3. Holder apparatus as recited in claim 1 wherein said bottle support means utilizes a single support or a pair of opposing supports and a securing strap that includes a temporarily securable means, whereby said support or supports can accommodate a number of different nursing bottle shapes, sizes, and materials, allow the clamping force applied to the bottle to be adjusted to suit bottle size and weight, and also allow a bottle to be secured after it is properly positioned within said apparatus so that said apparatus can be installed after manual feeding had begun without disrupting the feeding process.

4. Holder apparatus as recited in claim 1 wherein said base assembly is foldable resulting in base assembly components being positioned above and below said gimbal support and any apparatus mounted therein, whereby said gimbal support and apparatus can be secured and protected from damage during storage or transport, and said base assembly components can be used as handles for transportability.

5. Holder apparatus as recited in claim 1 wherein said bottle support means is freely pivoted about an axis that intersects the longitudinal axis of said nursing bottle while within said bottle support.

6. Holder apparatus as recited in claim 5 wherein said bottle support means is freely pivoted about an axis which intersects both said pivot axis and longitudinal axis of a nursing bottle while mounted within said bottle support.

7. Holder apparatus as recited in claim 1 wherein said bottle support means is freely rotatable about an axis intersecting or parallel to rotation axis of said gimbal support structure.

* * * * *